US007037016B1

(12) United States Patent
Nelson

(10) Patent No.: US 7,037,016 B1
(45) Date of Patent: May 2, 2006

(54) NENE BODY TOUCH

(76) Inventor: Andrea Nelson, 2635 Arlington Dr., Alexandria, VA (US) 22306

( * ) Notice: Subject to any disclaimer, the term of this patent is extended or adjusted under 35 U.S.C. 154(b) by 0 days.

(21) Appl. No.: 11/112,676

(22) Filed: Apr. 24, 2005

Related U.S. Application Data

(60) Provisional application No. 60/576,649, filed on Jun. 4, 2004.

(51) Int. Cl.
*A46B 5/02* (2006.01)
*B05C 21/00* (2006.01)

(52) U.S. Cl. ..... 401/6; 401/196

(58) Field of Classification Search ..... 401/6, 401/196, 203, 204, 205, 206; 601/137, 138; D28/7; D4/107, 108
See application file for complete search history.

(56) References Cited

U.S. PATENT DOCUMENTS 4,078,865 A 3/1978 Moser
D265,255 S * 6/1982 O'Neil ..... D28/7
4,861,180 A * 8/1989 Adams ..... 401/195
4,896,984 A * 1/1990 Evans ..... 401/140
D306,082 S * 2/1990 Kidd ..... D28/7
D323,409 S * 1/1992 Giese ..... D28/7
5,240,339 A 8/1993 DeForest
D341,222 S * 11/1993 Corrigan ..... D28/7
D353,223 S * 12/1994 Moore ..... D28/7
5,445,596 A * 8/1995 Grace ..... 601/154
5,890,824 A * 4/1999 Loch ..... 401/6
6,042,286 A 3/2000 Pazienza
6,550,996 B1 * 4/2003 Rayfield ..... 401/6

* cited by examiner

*Primary Examiner*—David J. Walczak

(57) ABSTRACT

A comfort device which is both an oil applicator and backscratcher, and can also be used as a back massager. The device has a hollow handle which includes a volume of liquid that can be applied, with the volume of liquid being lotion, liquid soap, or oil. The applicator end of the device has both a back scratching mechanism and also a sponge to allow application of a portion of the volume of liquid.

11 Claims, 2 Drawing Sheets

NENE BODY TOUCH

CROSS-REFERENCE TO RELATED APPLICATIONS

This application claims the benefit of U.S. Provisional Application No. 60/576,649, file Jun. 4, 2004.

BACKGROUND OF THE INVENTION

The present invention concerns that of an apparatus which is both an oil applicator and backscratcher, and can also be used as a back massager.

DESCRIPTION OF THE PRIOR ART

U.S. Pat. No. 4,078,865, issued to Moser, discloses a sponge type liquid applicator device attached to an elongated tube with threaded means to engage a supply, for accessing hard to reach places of the body such as the back.

U.S. Pat. No. 5,240,339, issued to DeForest and U.S. Pat. No. 6,042,286, issued to Pazienza, disclose various additional elongated body lotion applicator devices.

SUMMARY OF THE INVENTION

The present invention concerns that of an apparatus which is both an oil applicator and backscratcher, and can also be used as a back massager. The apparatus has a hollow handle which includes a volume of liquid that can be applied, with the volume of liquid being lotion, liquid soap, or oil. The applicator end of the apparatus has both a back scratching mechanism and also a sponge to allow application of a portion of the volume of liquid.

There has thus been outlined, rather broadly, the more important features of a comfort apparatus that the detailed description thereof that follows may be better understood and in order that the present contribution to the art may be better appreciated. There are, of course, additional features of the comfort apparatus that will be described hereinafter and which will form the subject matter of the claims appended hereto.

In this respect, before explaining at least one embodiment of the comfort apparatus in detail, it is to be understood that the comfort apparatus is not limited in its application to the details of construction and to the arrangements of the components set forth in the following description or illustrated in the drawings. The comfort apparatus is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present comfort apparatus. It is important, therefore, that the claims be regarded as including such equivalent constructions insofar as they do not depart from the spirit and scope of the present invention.

It is therefore an object of the present invention to provide a comfort apparatus which has all of the advantages of the prior art and none of the disadvantages.

It is another object of the present invention to provide a comfort apparatus which may be easily and efficiently manufactured and marketed.

It is another object of the present invention to provide a comfort apparatus which is of durable and reliable construction.

It is yet another object of the present invention to provide a comfort apparatus which is economically affordable and available for relevant market segment of the purchasing public.

Other objects, features and advantages of the present invention will become more readily apparent from the following detailed description of the preferred embodiment when considered with the attached drawings and appended claims.

DESCRIPTION OF THE PREFERRED EMBODIMENT

Figure 1:
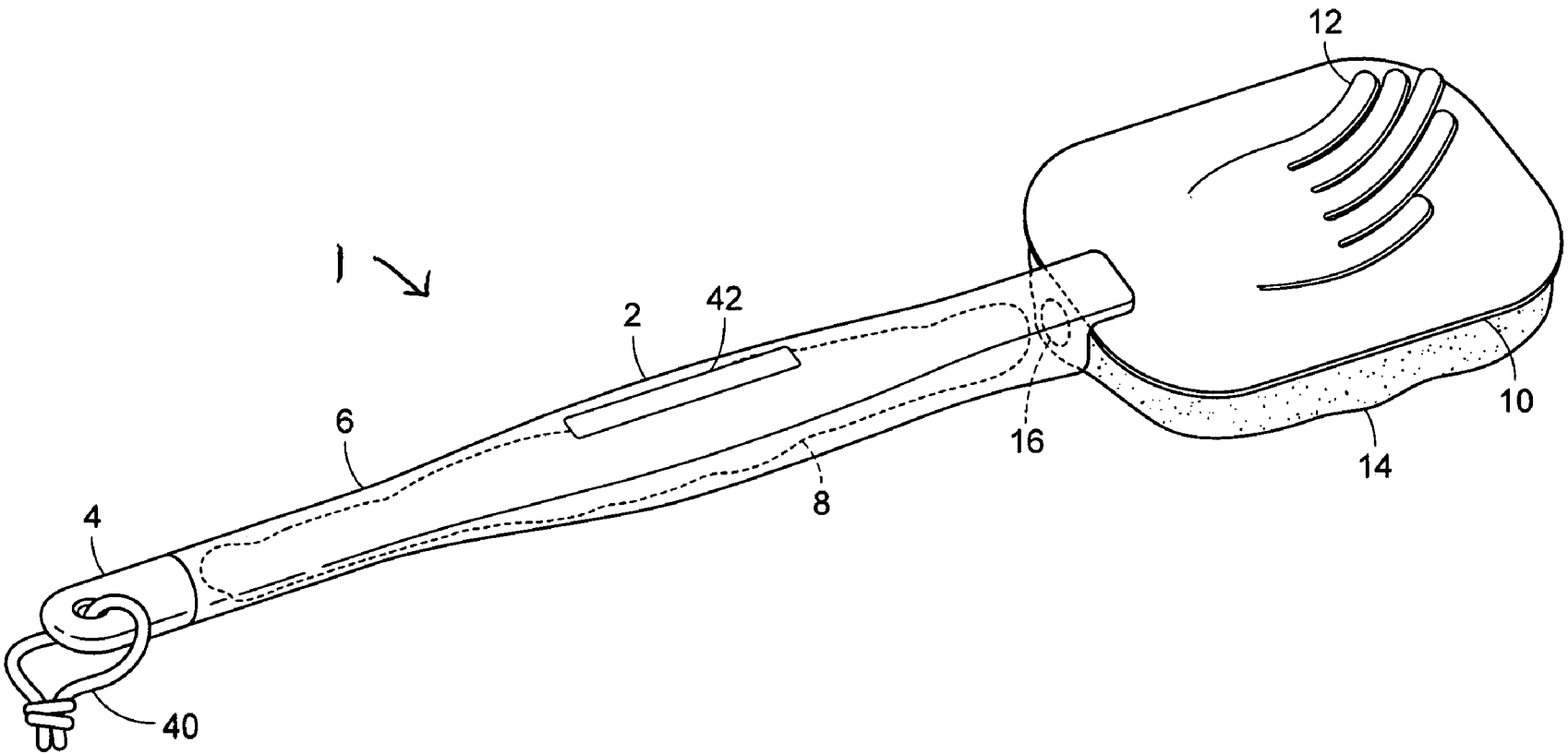
FIG. 1 shows a perspective view of the apparatus.

FIG. 1 shows a perspective view of the apparatus 1. Apparatus 1 is designed to be both an oil applicator and a backscratcher, and can also be used as a back massager.

Apparatus 1 comprises a main segment 2 that has two ends, a first end and a second end. The first end of the main segment 2 has a removable cap 4 which covers the handle 6. The handle 6 itself occupies most of the length of the main segment 2 and has two ends, a first end and a second end. Handle 6 is hollow to allow for the placement of a volume of liquid 8 within the handle 6. The first end of the handle 6 is the end attached to the removable cap 4.

The second end of the main segment 2 has a backing plate 10 which has two surfaces, an outer surface and an inner surface. The outer surface of the backing 10 has a plurality of prongs 12 sticking slightly outward, allowing the prongs 12 to serve as a back scratcher. The prongs 12, as shown in FIG. 1, are shaped like a human hand. However, the prongs 12 themselves can take on a wide variety of shapes and/or sizes and still fall within the scope of the present invention.

Attached to the inner surface of the backing 10 is a sponge 14. Sponge 14 is connected to the second end of the handle 6, which has a small opening 16. The volume of liquid 8 located in the handle 6 will slowly exit out of the small opening 16 into the sponge 14, where it can be rubbed onto various parts of a person's body.

Figure 2:
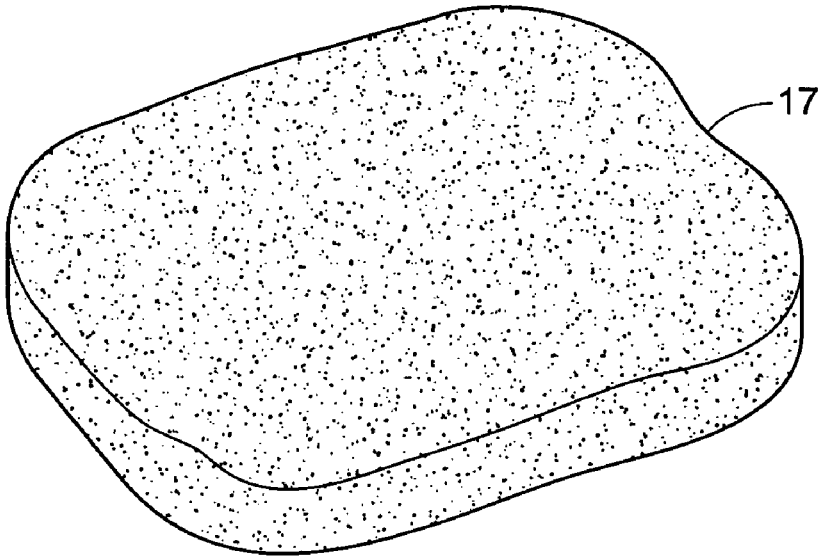
FIG. 2 shows a piece of loofah which can be substituted in lieu of a sponge in the apparatus.

The volume of liquid 8 within the handle 6 can be a wide variety of liquids, such as lotion, soap, or oil. Furthermore, the sponge 14 can be replaced by loofah 17 or other materials, as long as the materials are exfoliating. A piece of loofah 17 is shown in FIG. 2.

Looking back at FIG. 1, removable cap 4 has a small hanging rope 40 that will allow the apparatus 1 to be hung when not in use. Furthermore, the handle 6 has a location for a product name 42 to be placed on it.

Figure 3:
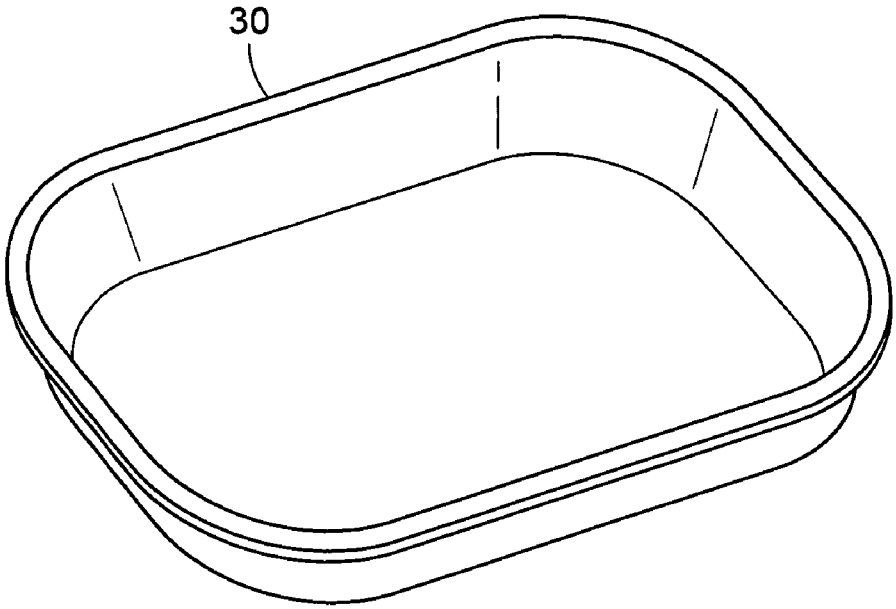
FIG. 3 shows a perspective view of a cover for use with the apparatus.

FIG. 3 shows a perspective view of the removable cover 30. Cover 30 can be placed over the sponge 14, loofah 17, or other exfoliating agent when the apparatus 1 is not in use. The cover 30 will protect the material from drying out or being gunked up with too much of the volume of liquid 8.

What I claim as my invention is:

1. A comfort apparatus comprising:

a main segment having a first end and a second end, a handle located at the first end of the main segment, the handle having a first end and a second end, the handle being hollow, a removable cap attached to the first end of the handle, a small opening located on the second end of the handle, volume of liquid within the handle, a flat, plate attached to the second end of the main segment, the plate having a first surface, a second surface surface, and a peripheral edge, a plurality of prongs protruding from the first surface distant from the peripheral edge, the plurality of prongs extending substantially horizontal from the plate and curving outward to extend substantially vertical to the plate, the plurality of prongs being shaped like a human hand, an object for scrubbing an individual, the object attached to the second surface of the plate, means for hanging the comfort apparatus when the comfort apparatus is not in use, wherein an amount of the volume of liquid will exit the small opening located on the second end of the handle and enter the object for scrubbing an individual, further wherein the individual will use the object for scrubbing an individual on the comfort apparatus as a cleaning agent for scrubbing.

2. A comfort apparatus according to claim 1 wherein the means for hanging the comfort apparatus when the comfort apparatus is not in use further comprises a hanging rope, the hanging rope attached to the removable cap.

3. A comfort apparatus according to claim 1 wherein the comfort apparatus further comprises a product name, the product name being placed on the handle.

4. A comfort apparatus according to claim 1 wherein the object for scrubbing an individual attached to the second surface of the plate comprises a sponge.

5. A comfort apparatus according to claim 1 wherein the volume of liquid located within the handle comprises a volume of lotion.

6. A comfort apparatus according to claim 1 wherein the volume of liquid located within the handle comprises a volume of soap.

7. A comfort apparatus according to claim 1 wherein the volume of liquid located within the handle comprises a volume of oil.

8. A comfort apparatus according to claim 1 wherein the object for scrubbing an individual attached to the surface of the plate comprises loofah.

9. A comfort apparatus according to claim 8 wherein the volume of liquid located within the handle comprises a volume of lotion.

10. A comfort apparatus according to claim 8 wherein the volume of liquid located within the handle comprises a volume of soap.

11. A comfort apparatus according to claim 8 wherein the volume of liquid located within the handle comprises a volume of oil.

* * * * *